US006334303B1

(12) United States Patent
Berglund et al.

(10) Patent No.: US 6,334,303 B1
(45) Date of Patent: Jan. 1, 2002

(54) FLAMEHOLDER DEVICE FOR AFTERBURNERS IN GAS TURBINE ENGINES

(75) Inventors: Joakim Berglund; Ronald Borg; Jens Dahlin; Peter Emvin; Stefan Hansson; Ola Isaksson; Peter Ivarsson; Henrik Johansson, all of Trollhättan; Torbjörn Salomonson, Vänersborg; Anders Sjunnesson, Trollhättan, all of (SE)

(73) Assignee: Volvo Aero Corporation, Trollbättan (SE)

( * ) Notice: Subject to any disclaimer, the term of this patent is extended or adjusted under 35 U.S.C. 154(b) by 0 days.

(21) Appl. No.: 09/367,139

(22) PCT Filed: Dec. 8, 1997

(86) PCT No.: PCT/SE97/02044

§ 371 Date: Oct. 29, 1999

§ 102(e) Date: Oct. 29, 1999

(87) PCT Pub. No.: WO99/30084

PCT Pub. Date: Jun. 17, 1999

(Under 37 CFR 1.47)

(51) Int. Cl.[7] ..... F02K 3/10
(52) U.S. Cl. ..... 60/261
(58) Field of Search ..... 60/281, 740

(56) References Cited

U.S. PATENT DOCUMENTS

| | | | | |
|---|---|---|---|---|
| 3,999,378 A | * | 12/1976 | Tatem | 60/39.65 |
| 4,064,691 A | * | 12/1977 | Nash | 60/39.06 |
| 5,396,763 A | | 3/1995 | Mayer et al. | 60/261 |

FOREIGN PATENT DOCUMENTS

| | | |
|---|---|---|
| EP | 0620404 | 10/1994 |
| WO | 9221872 | 12/1992 |

* cited by examiner

*Primary Examiner*—Timothy S. Thorpe
*Assistant Examiner*—Ehud Gartenberg
(74) *Attorney, Agent, or Firm*—Ostrolenk, Faber, Gerb & Soffen, LLP

(57) ABSTRACT

The invention refers to a flameholder device for afterburners in gas turbine engines with a cooling air fan of by-pass type, comprising a plurality of radial flameholder means (1) which at their radially outer end are mounted to the afterburner casing (2) and have a longitudinal air channel which ends at the radially inner end of said means (1), at which end is arranged a circumferentially extending arcuate flameholder gutter. In order to provide for a relief of the stresses from said flameholder device on the casing (2) it is suggested according to the invention that the flameholder means (1) at their radially outer ends each are pivotably and releasably mounted to said casing and in that the gutters of the respective flameholder means are formed as a common integral annular supporting and load-carrying body (14).

8 Claims, 4 Drawing Sheets

FLAMEHOLDER DEVICE FOR AFTERBURNERS IN GAS TURBINE ENGINES

BACKGROUND OF THE INVENTION

The present invention refers to a flameholder device for afterburners in gas turbine engines with a cooling air fan of by-pass type, comprising a plurality of air-cooled radial flameholder means which at their radially outer end are mounted to the afterburner casing and connected to the cooling air bypass duct and have a longitudinal air channel which ends at the radially inner end of said flameholder means, at which end is arranged a circumferentially extending arcuate flameholder gutter of generally V-shape in cross-section and with the open end of the "V" facing down-stream.

Particularly in military aircraft gas turbine engines are often used afterburners for providing a temporary additional thrust. In said afterburner is combusted a mixture of fuel, hot core air from the core engine and cooler air from the by-pass duct. For obtaining ignition and combustion there must be present a stable zone with low gas flow speeds and for that purpose flameholder means are used since long. When the temperature of the afterburner is very high, particularly when ignited, the flameholder means are subjected to a very severe environment. Despite this fact the flameholder means mostly are non-cooled and therefore have a limited service life. Cooling of the flameholder means has been suggested and implied the solution of many problems but instead also created new problems since the differences in temperature between various portions of the flameholder means may give reason to low-cycle fatigue which reduces the service life substantially. As examples of prior air-cooled flameholder means it might be referred to i.e. U.S. Pat. Nos. 5,396,761 and 5,396,763 and FR-2 709 342.

Thus the great thermal load on the flameholder means causes their service life to be short and therefore they must be subjected to maintenance and often exchange at short time intervals. In doing so, the whole engine usually need to be dismantled from the aircraft which is both time-consuming and expensive as well as not particularly adapted for field service in military applications. In the structures according to the above-mentioned prior art the flameholder means are mounted to the external engine casing by means of bolts which requires that said casing has to be reinforced which will make it heavier and that is a severe drawback. The bolt connections also contribute to the time consumption in maintenance and exchange.

In the prior construction known from U.S. Pat. No. 5,396,761 the flameholder means support at their radially inner end a transverse gutter-shaped shield means which together with the adjacent means form a circumferential supplemental shield assembly.

SUMMARY OF THE INVENTION

The object of the present invention is to suggest an improved design of a flameholder device of the aforementioned kind and said invention is distinguished substantially in that the flameholder means at their radially outer ends each are pivotably and releasably mounted to the afterburner casing on a tangential axis and in that the gutters of the respective flameholder means are formed as a common integral annular supporting and load-carrying body.

Owing to the invention it is now achieved that the flameholder means at their radially outer end no longer are secured to the edging casing by a rigid bolt connection but by means of a pivot pin so as to take no moment and to allow increased movability during the expansion of the flame tube of the engine and an improved distribution of the transfer of load from the flameholder device in its entirety to the outer casing of engine. The common annular body, namely, will distribute the stresses to all the flameholder means and hence to the engine casing which is very advantageous. Finally, the mounting of the flameholder means on a pivot pin provides that in maintenance and exchange said pins easily are removed and the whole flameholder device dismantled without need to remove the whole engine from the aircraft. Should also each flameholder means be mounted to the common annular body by means of similar pin connection said means also may be easily exchanged individually if desired.

In a flameholder device of this kind it is also a problem to reliably obtain the ignition of the afterburner under certain parts of the flight envelope, particularly when flying at high altitude.

A further development of the present invention now has for an object to provide a solution of this problem and suggest a design of the flameholder means which assures a reliable ignition of the afterburner during all conditions of operations, still at low manufacturing costs. Said embodiment is substantially distinguished in that within the flameholder means is arranged a longitudinal evaporator tube which at its radially inner end opens adjacent the inner end of the flameholder means and the radially outer end with its mouth is substantially facing the meeting core flow of the gas turbine, upstream of which evaporator tube end being mounted a fuel spreader for spraying fuel into said tube mouth, and the pressure within the forward end of the flameholder means being selected to be higher than the pressure inside the evaporator tube, and in that at some distance inwardly of the rear wall of the flameholder means, as seen in the main flow direction, is located a guide wall which delimits a rear cooling air duct, into which at the radially inner end of the flameholder means, the fan air flowing around the evaporator tube is directed and which debouches at the radially outer end of the flameholder means.

Owing to said features it is now obtained in a very simple way a highly improved cooling effect on the flameholder means without any risks for difficulties when reigniting the afterburner, particularly at high altitudes. This is due to the separation of the cooling and evaporation functions of the flameholder means.

BRIEF DESCRIPTION OF THE DRAWINGS

The invention will be further described below with reference to the accompanying drawing, in which FIG. 2 illustrates a partial front view of the flameholder device according to the invention and shows particularly one of the flameholder means being located downstream a fuel spreader and FIG. 3 is a perspective view of a flameholder means according to the invention made of sheet metal.

DESCRIPTION OF THE PREFERRED EMBODIMENT

Figure 1A:
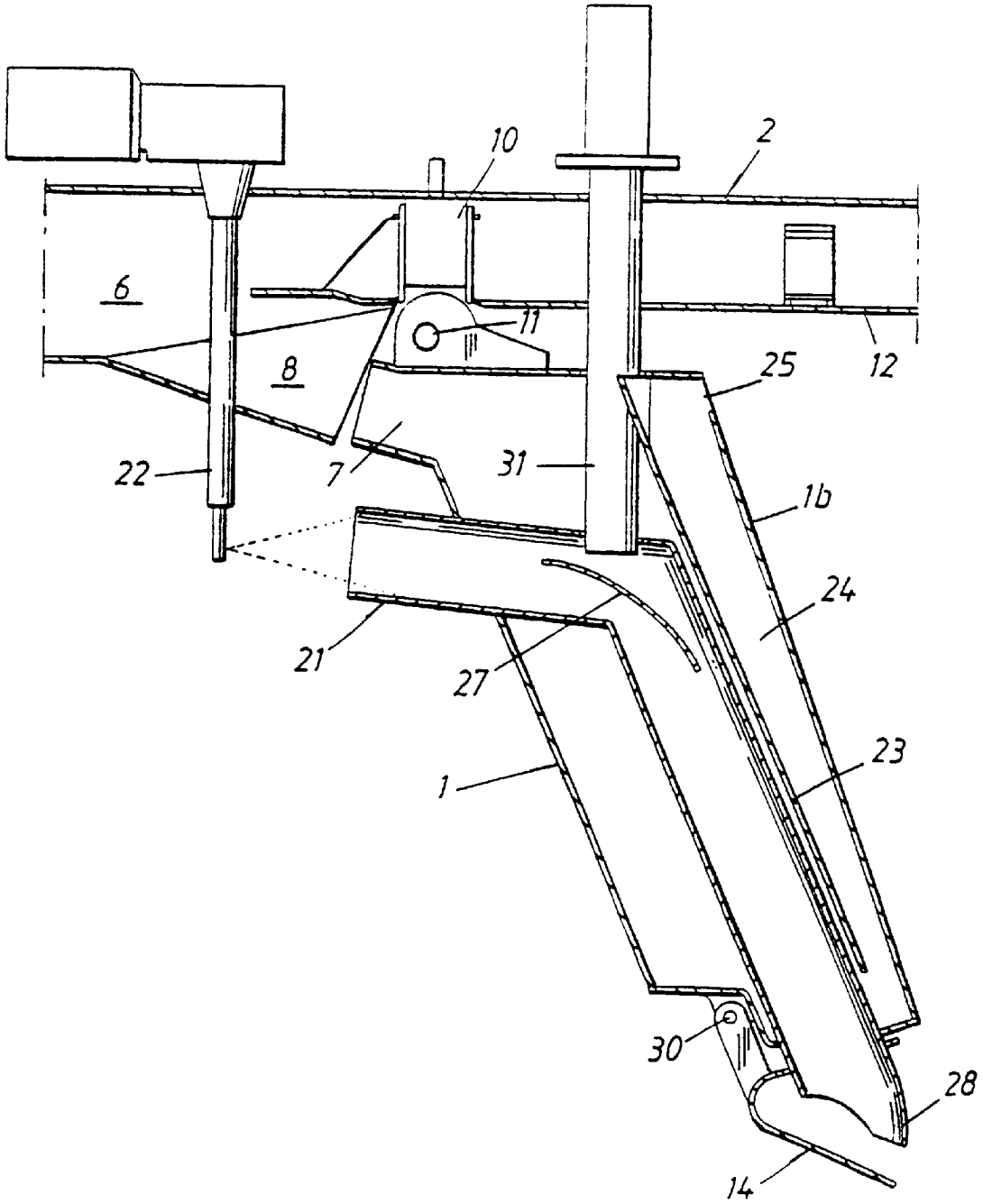
FIG. 1*a* and FIG. 1*b* illustrate a longitudinal section of a portion of an afterburner in a gas turbine engine, FIG. 1*a* being taken through that one of the flameholder means being provided with a spark plug while FIG. 1*b* being taken through one of the other flameholder means.
Figure 1B:
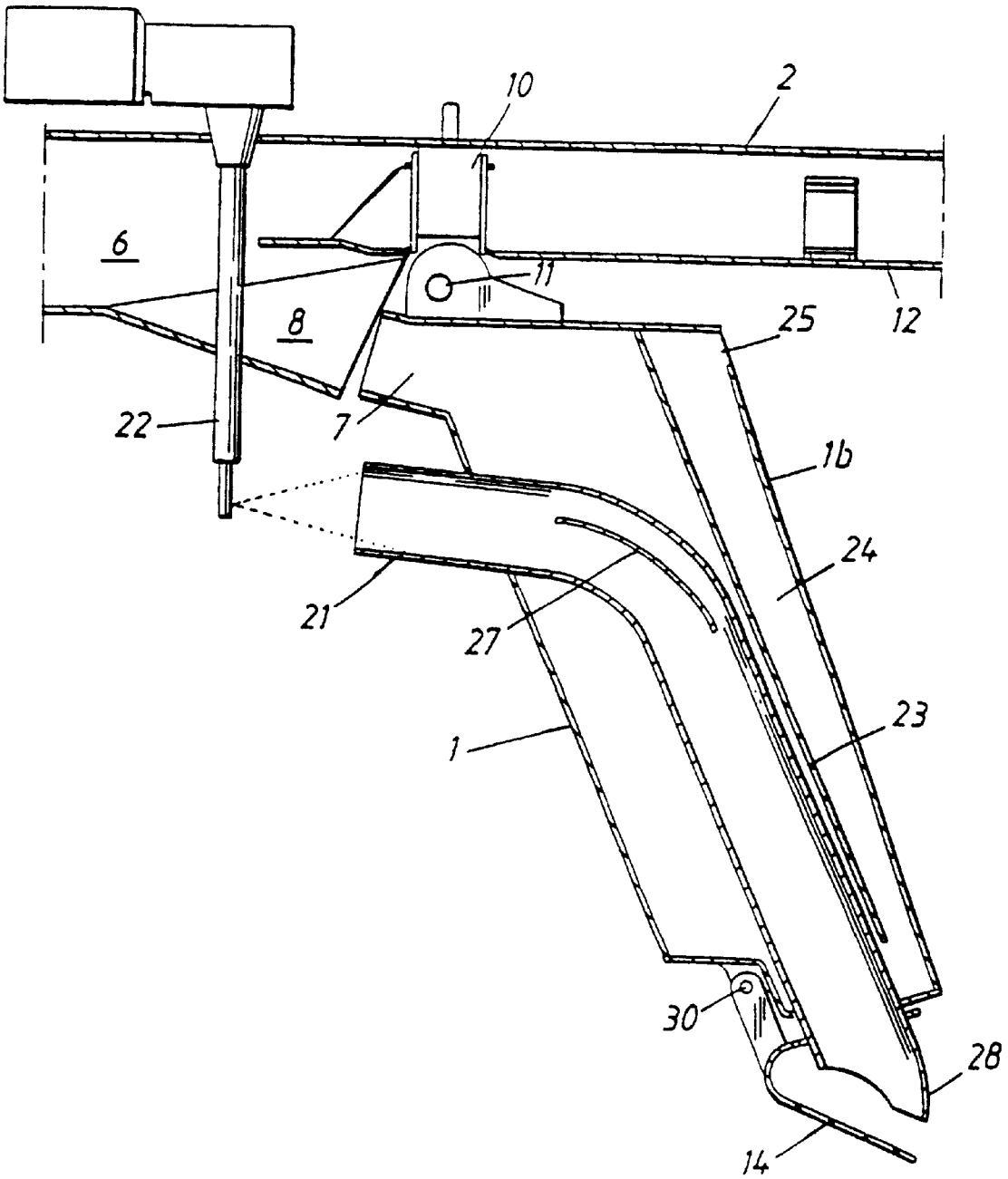

As is evident from the drawing, a number of radially directed flameholder means or segments 1 are suspended as known per se evenly distributed circumferentially from the outer casing 2 of a gas turbine engine not further illustrated. In longitudinal direction, said circular row of flameholder means preferably is located at the level of the rear central cone of the engine. The number of segments or finger-like flameholder means might be selected between 8 and 16, in the present case 12. Usually, the flameholder means are formed by bending a heat-resistant sheet material and preferably have triangular cross section with one of its corners turned upstream. One of the flameholder means 1 is provided with a spark plug 31.

Each flameholder means 1 is intended to be through-flown by cooling air which is derived from a surrounding air duct 6 inside the engine casing 2 and is directed into an opening 7 in the front wall of the flameholder means 1 at the radially outermost end thereof. This is provided with the aid of a guiding depression or a fold 8 in a mixing means in the inner wall of the air duct 6.

According to the invention, each flameholder means 1 is pivotally suspended at its radial outer end from the surrounding casing 2 under the intermediation of a mounting means 10 having a pivot pin 11 extending tangentially. Said pivotable suspension by the pin 11 implies that tensional forces are eliminated and that the flame tube 12 may expand freely when heated.

Figure 3:
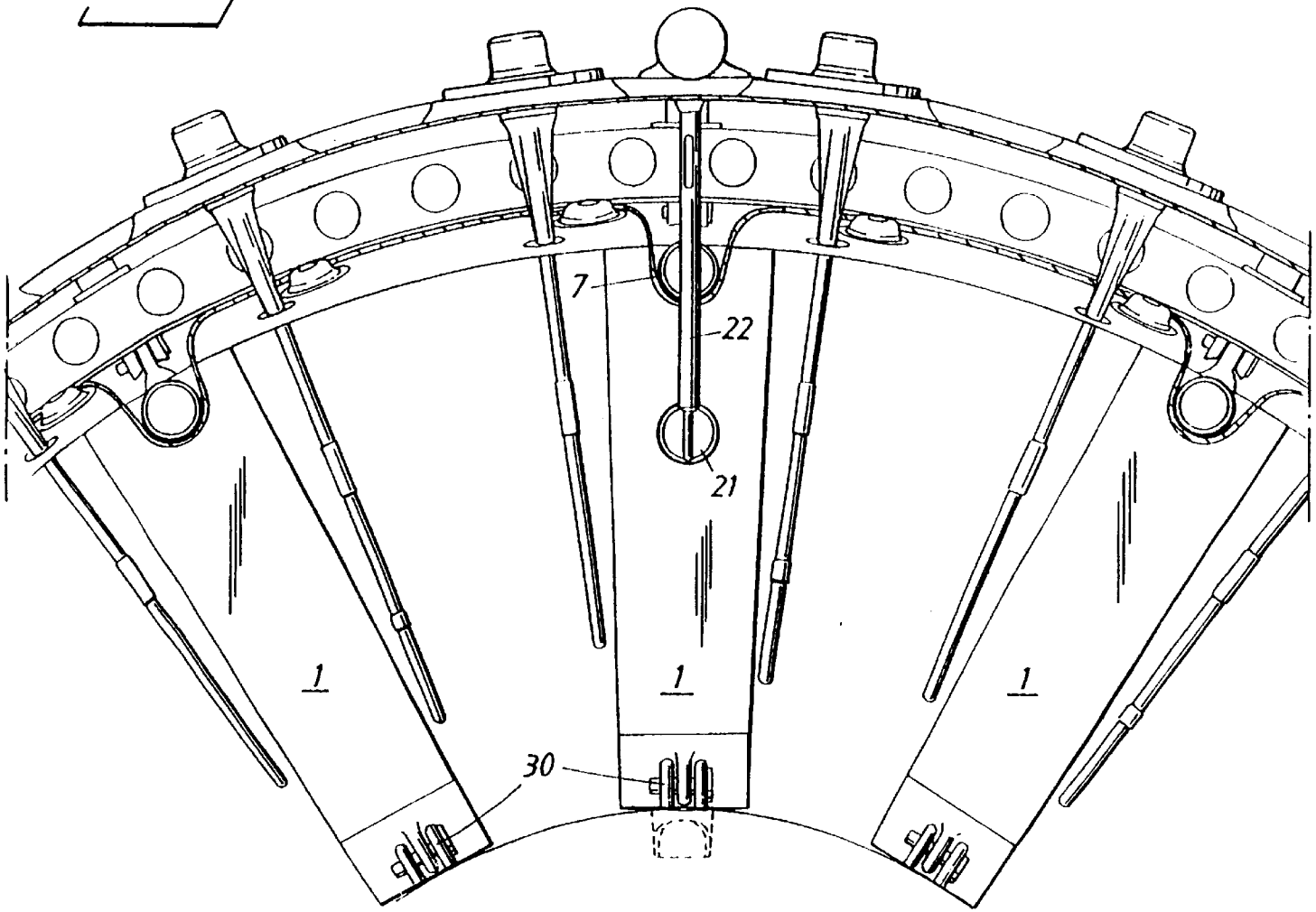
Figure 3:
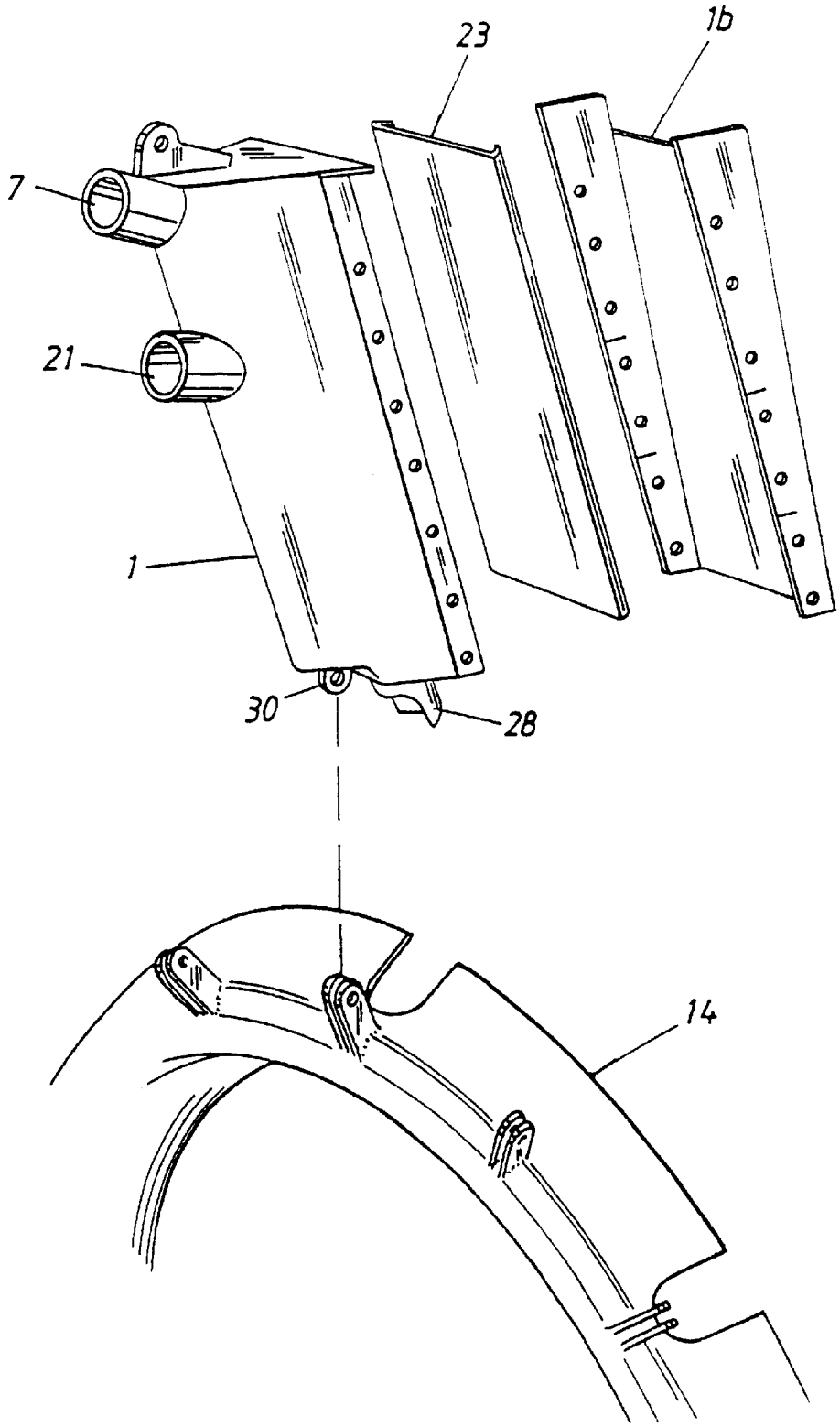

Further according to the invention, within one or all of the flameholder means is mounted a longitudinal evaporator tube 21 which with its radially inner end discharges adjacent the inner end of the flameholder means 1. The radially outer end of the evaporator tube 21 is turned with its mouth substantially towards the meeting core flow from the gas turbine, said evaporator tube 21 thus generally having a curved shape. This end of the evaporated tube 21, turned towards the meeting core flow, preferably protrudes slightly from the front wall of the flameholder means 1 such as is illustrated in FIG. 3.

Spaced upstream from said inlet end of the evaporator tube 21 is located a fuel spreader 22, which is adapted to direct a jet of fuel towards said end. It is suitable to select the pressure within the front portion of the flame holder means 1 such that it is higher than the pressure in the evaporated tube 21 in order to avoid that vaporized fuel can penetrate exteriorly thereof in case of crack formation.

Furthermore, according to the invention, spaced inwardly of the rear wall 1*b* of the flame holder means 1, as seen in the main flow direction, there is located a longitudinal guide wall 23 which delimits a rear cooling air duct 24. The air from the fan introduced into the opening 7 from the fold 8 of the mixer means thus flows radially inwardly through the entire flameholder means 1 while surrounding the evaporator tube 21 along the outer surface thereof and is then, since the flameholder means 1 at its radially inner end is substantially entirely closed, guided around the lower end of the guide wall 23 and upwardly through the duct 24 and then leaves the flameholder means 1 at a rearwardly directed outlet 25 at the radially outer end of said flameholder means 1. Suitably, the area of the cooling air duct 24 is selected substantially smaller than the cross sectional area of the rest of the flameholder means 1 with the evaporator tube 21 mounted therein in order to substantially increase the speed of the cooling air flow and hence to provide an increased cooling effect.

At the radially inner end the flameholder means 1 are preferably releasably connected at 30 to a common annular body 14 of gutter-like shape with the open end facing rearwardly or downstream and which forms a shield means. Preferably said annular body 14 is coated with a ceramic protection layer, a so-called TBC layer, at its downstream side.

However, it is suitable to form at the radially inner end of the flameholder means 1 a small calibrated outlet aperture for cooling air, which then will sweep the mounting point 30 and cool the same.

It is suitable that the evaporator tube 21 in the curved transition area between its inlet and outlet portions is provided with a guide surface member 27 adapted to maintain a laminar flow in this area and hence to avoid turbulence and self-ignition of the vaporized fuel. Furthermore, at its radially inner end the evaporator tube 21 may be provided with a spout-like elongation 28 at the downstream side in order to provide a tangential distribution of the ignition fuel.

In case the flameholder means 1, as is particularly illustrated in FIG. 3, is made from sheet metal its rear wall 1*b* as seen in the main flow direction can be secured to the rest of the flameholder means by a rivet connection which allows an equalization of heat stresses.

Preferably the flameholder means according to the invention are of simple design of bent sheet metal which consequently are inexpensive to manufacture. The joining of the segment portions is carried out by means of bending, welding and riveting which leads to a structure which might expand and move without cracking. The flameholder means and all their inherent parts also may be exchanged without necessity for removing the engine out of the aircraft. In engine tests it has been settled that the cooling of the radial segments or flameholder means is very effective. The rear side 1*b* of the segments which is subject to the convective heat from the flame have a temperature sufficiently low for filling the service life requirements. The evaporator tubes, in which fuel is mixed with core air, provides for an adaptation of the evaporating distance such that as great a quantity of fuel as possible can be transferred into vaporized condition in all relevant conditions of flying.

What is claimed is:

1. A flameholder device for afterburners in gas turbine engines with a cooling air fan of by-pass type, comprising a plurality of air-cooled radial flameholder means (1) which at their radially outer end are mounted to the after-burner casing (2) and connected to the cooling air bypass duct (6) and have a longitudinal air channel which ends at the radially inner end of said flameholder means, at which end is arranged a circumferentially extending arcuate flameholder gutter (14) of generally V-shape in cross-section and with the open end of the "V" facing downstream, characterized in that the flameholder means (1) at their radially outer ends each are pivotably and releasably mounted to the afterburner casing (2) on a tangential axis (11) and in that the gutters of the respective flameholder means (1) are formed as a common integral annular supporting and load-carrying body (14).

2. A flameholder device according to claim 1, characterized in that within the flameholder means (1) is arranged a longitudinal evaporator tube (21) which at its radially inner end opens adjacent the inner end of the flameholder means (1) and the radially outer end with its mouth is substantially facing the meeting core flow of the gas turbine, upstream of which evaporator tube end being mounted a fuel spreader (22) for spraying fuel into said tube mouth, and the pressure within the forward end of the flameholder means (1) being selected to be higher than the pressure inside the evaporator tube (21), and in that at some distance inwardly of the rear wall (1*b*) of the flameholder means (1), as seen in the main flow direction, is located a guide wall (23) which delimits a rear cooling air duct (24), into which at the radially inner end of the flameholder means (1), the fan air flowing around the evaporator tube (21) is directed and which debouches at the radially outer end of the flameholder means (1).

3. A device according to claim 1, characterized in that the evaporator tube (21) at its radially inner end is formed with a spout-like elongation (28) at the downstream side for tangential distribution of the ignition fuel.

4. A device according to claim 2, characterized in that in the evaporator tube (21) is mounted in the curved transitional area between the inlet and outlet portions thereof a guide bar (27) for maintaining a laminar flow in said area.

5. A device according to claim 1, characterized in that the respective flameholder means (1) at their radially inner end have a pivotable and releasable connection (30) to a common shield means (14).

6. A device according to any of claims 1–5, characterized in that in the radially inner end of the flameholder means (1) is located an opening for directing a predetermined cooling air flow towards the connection (30) of the flameholder means (1) to a shield means (14).

7. A device according to claim 1, characterized in that in one of the flameholder means (1) is mounted a spark plug (31), which extends into an evaporator tube (21).

8. A device according to claim 1, in which the flameholder means (1) is made of sheet metal, characterized in that the rear wall **(1*b*) of the flameholder means (1)**, as seen in the main flow direction, is adapted to be secured to the rest of said means through a rivet connection.

* * * * *